US006543527B1

(12) United States Patent
Bouzida et al.

(10) Patent No.: US 6,543,527 B1
(45) **Date of Patent: *Apr. 8, 2003**

(54) METALLIC COOLING FIN FOR A HEAT EXCHANGER, ESPECIALLY FOR A MOTOR VEHICLE

(75) Inventors: Samy Bouzida, Paris (FR); Christophe Mignot, Le Perray en Yvelines (FR); Mike V. Powers, Lake Wood, NY (US)

(73) Assignee: Valeo Thermique Moteur, La Verriere (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 410 days.

(21) Appl. No.: 08/991,717

(22) Filed: Dec. 16, 1997

(30) Foreign Application Priority Data

Dec. 18, 1996 (FR) ..... 96 15584

(51) Int. Cl.[7] ..... F28D 1/04

(52) U.S. Cl. ..... 165/152; 165/DIG. 487; 165/182

(58) Field of Search ..... 165/151, 152, 165/182, DIG. 487, DIG. 503

(56) References Cited

U.S. PATENT DOCUMENTS 3,250,325 A 5/1966 Rhodes et al.
5,035,052 A 7/1991 Suzuki et al.

*Primary Examiner*—Allen Flanigan
(74) *Attorney, Agent, or Firm*—Morgan & Finnegan, LLP

(57) ABSTRACT

A metallic cooling fin for a motor vehicle heat exchanger has a central part having at least one set of fixed inclined lamellae, of selected form and spaced apart by apertures, the dimensions of which are predetermined to enable a fluid to pass between the lamellae. The lamellae in a common set are distributed in at least two groups, with the respective inclinations of the lamellae varying from one group to the other.

15 Claims, 2 Drawing Sheets

METALLIC COOLING FIN FOR A HEAT EXCHANGER, ESPECIALLY FOR A MOTOR VEHICLE

FIELD OF THE INVENTION

This invention relates to heat exchangers, especially for motor vehicles. More particularly, the invention relates to metallic cooling fins used in heat exchangers of either the brazed type or the built-up type (in which the components are assembled together mechanically), the cooling fins defining indirect heat transfer surfaces which augment the heat transfer surfaces between the heat exchanger tubes (in which a first, hot or cold, fluid flows), and a second fluid, such as air, which flows around or between the tubes.

BACKGROUND OF THE INVENTION

Such cooling fins are generally made in the form of plates which are superimposed one above another in a stack in a heat exchanger of the built-up type, and in that case the tubes extend through the stack of plates. In head exchangers of the brazed type, the cooling fins are generally accordion-shaped, i.e. they are corrugated, and in that case they are interposed as spacers or inserts between the tubes.

Some known types of cooling fins have a central part or middle section, which is formed with at least one set of fixed lamellae which are inclined (with respect for example to the axis of the tubes), and which are of selected form, being spaced apart by apertures of predetermined dimensions to enable the fluid to pass between the lamellae. This arrangement of lamellae is similar to that of a slatted window shutter, so that such fins can be referred to as slatted shutter fins: they are for example described in U.S. Pat. No. 5,289,874.

Although it is true that the provision of this slatted-shutter configuration on the indirect heat transfer surfaces of the cooling fins improves heat transfer performance, it does at the same time increase energy losses, and this reduces the output of the heat exchanger. This effect is increased, when a larger number of superimposed cooling fins is provided. It can be increased even more if the installation has several heat exchangers connected in series.

In addition, it is well known in the art that the slats in the slatted-shutter configuration, where these consist of lamellae of constant inclination, lead to energy losses which are greater as the inclination is greater, as is generally the case in known heat exchangers, in which the fins typically have an inclination of about 35°. Such angles give rise to separation of the boundary layer of the fluid flowing in contact with the cooling fins, at those locations at which the fluid, for example air, begins to change direction. As a result, low velocity zones, in which recirculation or cavitation of the air can occur, are created close to the walls. From the heat transfer point of view, such zones are detrimental because normal convection cannot take place in such zones.

DISCUSSION OF THE INVENTION

An object of the invention is to provide a metallic cooling fin which reduces or eliminates the drawbacks, such as those mentioned above, of known types of cooling fins. According to the invention, a metallic cooling fin for a heat exchanger, of the type comprising a central part having at least one set of inclined fixed lamellae of selected form, the lamellae being spaced apart by apertures of selected dimensions such as to allow passage of a fluid between the lamellae, is characterised in that the lamellae in said set are distributed in at least two groups each consisting of at least one lamella, the respective inclinations of which vary as between one group and another, the groups having an order number which increases with the inclination of their respective lamellae.

The inclination in the lamellae of one group will thus be steeper as the order number assigned to the group is higher. Thus the lamellae in a first group will have a first inclination, the value of which is lower than that of a second group, which will itself be lower than that of any third group. To the extent that the fins have lamellae of at least two different inclinations, energy losses are considerably reduced.

Preferably, two adjacent lamellae, with different inclinations, constitute part of two groups of lamellae, the order numbers of which follow each other or precede each other. For example, a lamella of the first group will be followed by a lamella of the second group, the inclination of which is greater. Thus changes in direction of the fluid flow vary progressively, and therefore more gently, and this enables separation of the boundary layer to be limited, thus giving an increased working indirect heat transfer surface area.

According to a preferred feature of the invention, the lamellae which are located respectively in the first rank of a set of lamellae (that is to say at the start of the set) and or in the last rank of the same set (that is to say at the end of the set), form part of the group of lamellae of the lowest order number referred to as the first group. This makes the changes in direction of the fluid flow even more gentle.

In a preferred embodiment of the invention, the cooling fin has at least one set consisting of at least two groups of lamellae comprising a first and a second group, having first and second inclinations respectively, the said set of lamellae having a median plane of symmetry. With this feature, such a set of lamellae comprises at least one first lamella of the first group, followed by at least one lamella of the second group, which itself may be followed by at least one final lamella of the first group.

In addition, some cooling fins in the prior art include, upstream of the lamella of the first rank, a fixed upstream auxiliary lamella which is spaced away from the lamella of the first rank by an aperture of a selected form. This auxiliary lamella is adapted to channel the fluid flow at the start of the set of lamellae. It generally has a length which is substantially equal to one half of the length of the lamellae in the set, so that it does not redirect the fluid by a sufficiently large amount.

In order to overcome this problem, and in accordance with another preferred feature of the invention, the cooling fin includes, upstream of the lamella of the first rank, a fixed upstream auxiliary lamella, the dimensions of which are substantially equal to or greater than the lamellae in the set, the said upstream auxiliary lamella being spaced away from the lamella of the first rank by an aperture of selected form. Thus, the free end of the upstream auxiliary lamella is located at a lower level than the respective levels of the lamellae in the set, and this leads to effective redirection of the fluid flow. The fluid is then at once well oriented, while, firstly, a good approach is obtained to the working edges of the lamellae in the series, and secondly, the probability of separation of the boundary layer from the wall is considerably reduced.

Some prior art cooling fins also have, downstream of the lamella of the last rank, a fixed downstream auxiliary lamella which is spaced away from the lamella of the last rank by an aperture of selected form. This downstream auxiliary lamella is adapted, like the upstream auxiliary lamella, to channel the fluid at the terminal or downstream end of the set. The length of this downstream auxiliary lamella is generally substantially equal to one half of the length of the lamellae in the set, which again results in insufficient redirection of the fluid flow.

In order to overcome this problem, and according to yet another preferred feature of the invention, the cooling fin includes, downstream of the lamella of the last rank in a set, a fixed downstream auxiliary lamella, the dimensions of which are substantially equal to or greater than those of the lamellae in the said set, the downstream auxiliary lamella being spaced away from the said lamella of the last rank by an aperture of selected form.

Where the cooling fin has at least two sets of lamellae in succession (comprising an upstream set and a downstream set), these latter may be connected together through the upstream auxiliary lamella of one set and the downstream auxiliary lamella of the other set. The junction between two sets of lamellae is a factor in energy loss, and this feature improves the output of the heat exchanger.

According to yet another preferred feature of the invention, the auxiliary lamellae have an inclination which is smaller than or equal to that of the lamellae in the first group of the set.

In preferred embodiments with this feature the inclination of the auxiliary lamellae is smaller than that of the lamellae in the first set by an amount in the approximate range 1° to 20°.

In some embodiments, that adjacent sets of lamellae have the same groups of lamellae. In that case, it is preferable that the groups having the same order number in two sets of adjacent lamellae have opposite orientations. This enables the fluid to be divided into layers, each of which penetrate between two lamellae of the upstream set, and leaves between the two corresponding lamellae of the downstream set, which are arranged symmetrically with respect to a median plane of symmetry.

In other embodiments, the adjacent sets of lamellae have different groups of lamellae.

Preferably, the inclinations of the lamellae are in the approximate range from 15° to 35°. Sharp inclinations, typically greater than 30°, will sometimes no longer have any disadvantages, because their detrimental influence on the fluid is compensated for, at least by the fact that lamellae of different inclinations are used.

According to still a further preferred feature of the invention, the inclination of the lamellae in the first group is smaller than that of the lamellae in the group having the highest order number, by a value in the approximate range 1° to 20°.

The invention is most particularly applicable to cooling fins made of alluminium or an aluminium alloy, or copper.

Further features and advantages of the invention will appear more clearly on a reading of the following detailed description of two preferred embodiments of the invention, which is given by way of non-limiting example and with reference to the accompanying drawings.

DESCRIPTION OF PREFERRED EMBODIMENTS OF THE INVENTION

The main purpose of the heat exchanger is to transfer heat between a first fluid flowing within some of the elements of the heat exchanger, and a second fluid which flows on the outside of the same element. To this end, the heat exchanger generally consists of tubes having ends which are open into hollow headers, with the first fluid flowing in the tubes, this being for example a refrigerant fluid. The second fluid, which is typically air, flows around the outside of the tubes.

With a view to improving the heat exchange (or heat transfer) performance of the heat exchanger, it is usual to increase the heat exchange surface, which is that of the walls of the tubes, by juxtaposing to the tube walls indirect heat exchange surfaces, here in the form of fins 2. These fins are of metal, and are preferably made of aluminium or an aluminium alloy. They could however also be made in other metals, for example copper.

Figure 1:
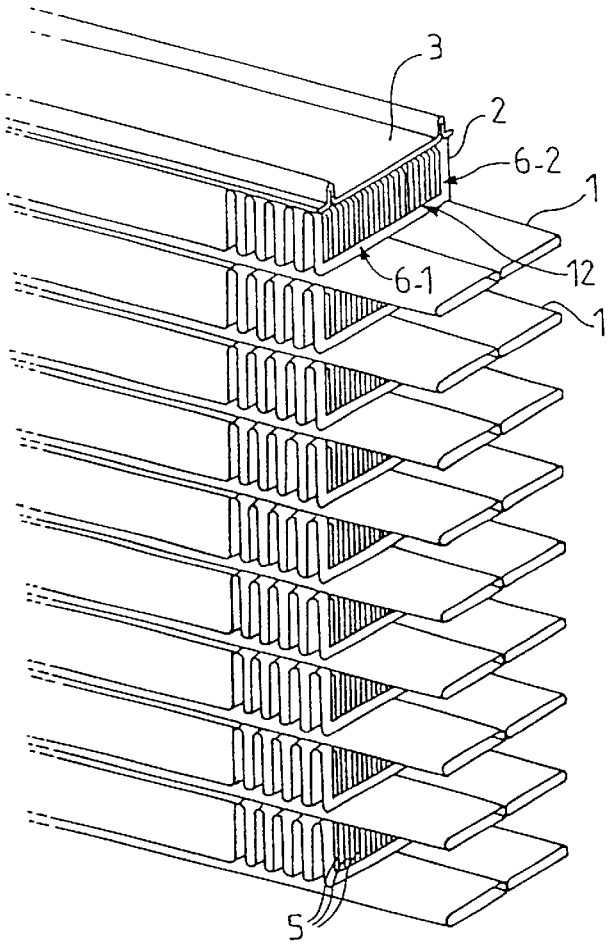
FIG. 1 is an isometric view showing part of a brazed heat exchanger equipped with corrugated fins.
Figure 2:
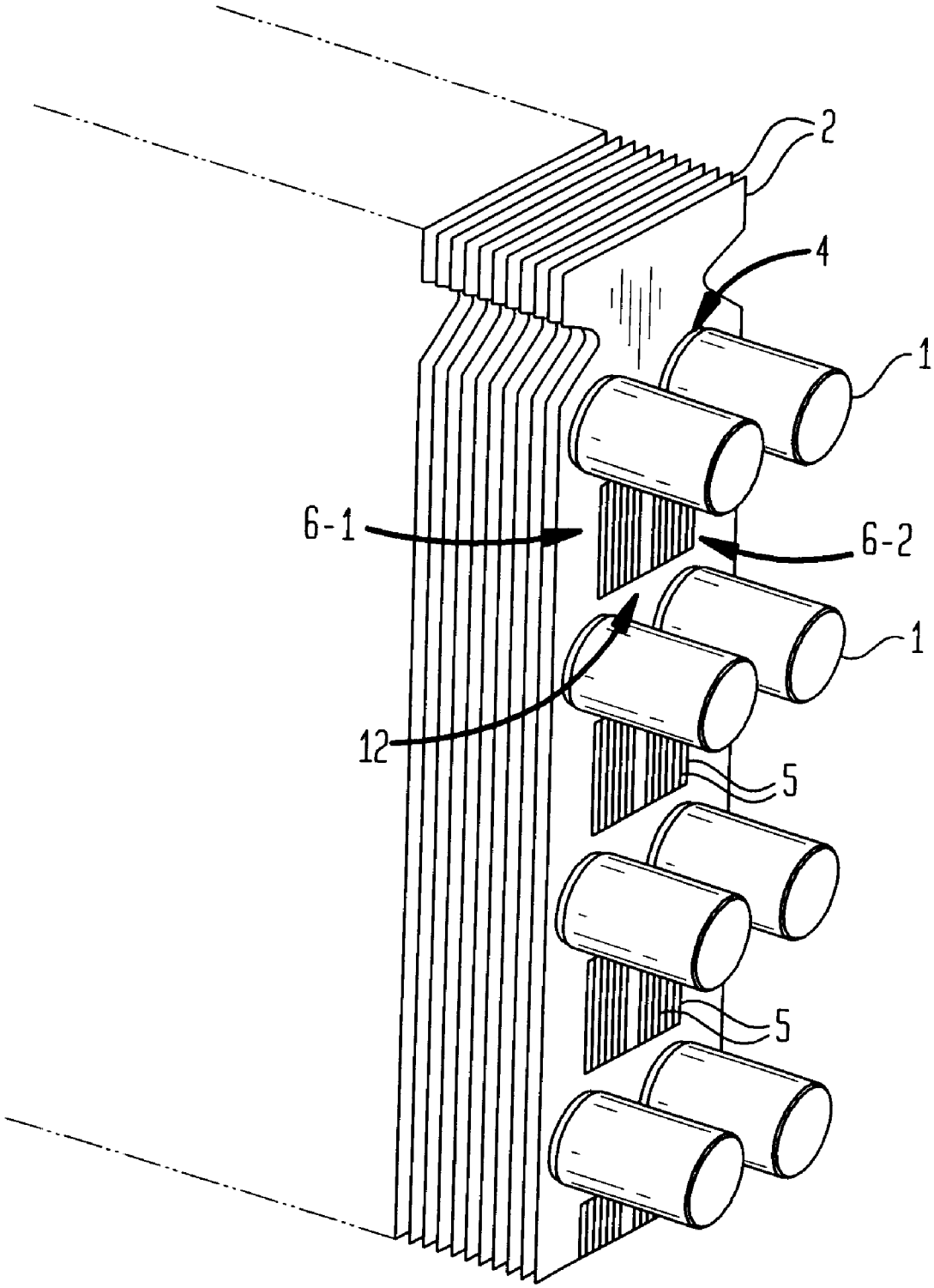
FIG. 2 is an isometric view showing part of a built-up heat exchanger equipped with flat fins.

As shown in FIGS. 1 and 2, the fins will assume substantially different forms depending on the type of heat exchanger concerned. Thus, in brazed heat exchangers as shown in FIG. 1, the fins 2 are made in form of plates which are bent substantially into an accordion or corrugated form. These fins can be referred to as spacers or inserts. Such an insert thus comprises a multiplicity of fin elements which are arranged substantially parallel to each other, in a position which is at right angles to the longitudinal axes of the tubes 1, each insert being arranged between two adjacent tubes 1, or between one end member of the heat exchanger and the first tube 1.

By contrast, in heat exchangers of the built-up type, which are assembled mechanically, as shown in FIG. 2 for example, the fins consist of flat plates in which holes holes 4 are formed through which the tubes 1 extend. This type of fin can be referred to as a plate fin. These flat plates are superimposed one above another, with the plate fins substantially parallel to one another and extending in a plane at right angles to the longitudinal axis of the tubes 1.

In both of these embodiments of the heat exchanger, each fin, whether in the form of an insert or a plate fin, is preferably made with a portion in the form of one or more slatted window shutters. Each of these slatted shutter portions is formed in a central part 12 of the corresponding fin 1, and consists of a set, 6, of lamellae 7, which generally have selected identical forms, and which are separated from each other by aperatures 8, the forms of which are again chosen to be identical to each other.

In the manufacture of the fins, the starting point for forming the slatted shutter portion in the fin is a metallic plate in which parallel cutouts are formed, these cutouts being spaced apart by a length L. Then, by configuring appropriately the metallic zones lying between two cutouts of width L, the lamellae 7 are formed while at the same time the aperatures 8 are formed.

In the prior art, the fins are fixed, and all have the same inclination with respect to an axis X—X which is contained in the plane of the fin and which is substantially at right angles to the alignment of the lamellae 7 in a set 6 of lamellae. The company Valeo Thermique Moteur has noticed that the manufacture of slatted shutter elements with lamellae of constant inclination has a certain number of disadvantages, especially as regards loss of energy, as explained in the introduction of this specification. This is why the lamellae in any one set 6 of lamellae has at least two different inclinations $\theta 1$ and $\theta 2$ (FIG. 3).

In consequence, a set 6 of lamellae comprises at least two identical fixed groups of lamellae, each group having its own inclination. Thus, in the example shown in FIG. 3, the set 6-1 comprises a first group of four lamellae 7-1 with an inclination $\theta_1$, and a second group of three lamellae 7-2 with an inclination $\theta_2$. It will of course be understood that three groups, or more than three groups, with different inclinations, may be provided if desired.

Preferably, the lamella in the first rank of a set (ie the first one starting at the left hand end in FIG. 3), together with the lamella in the last rank, ie the last lamella in the set going from the left or the first one in the set going from the right in the Figure, are all part of the first group.

Figure 3:
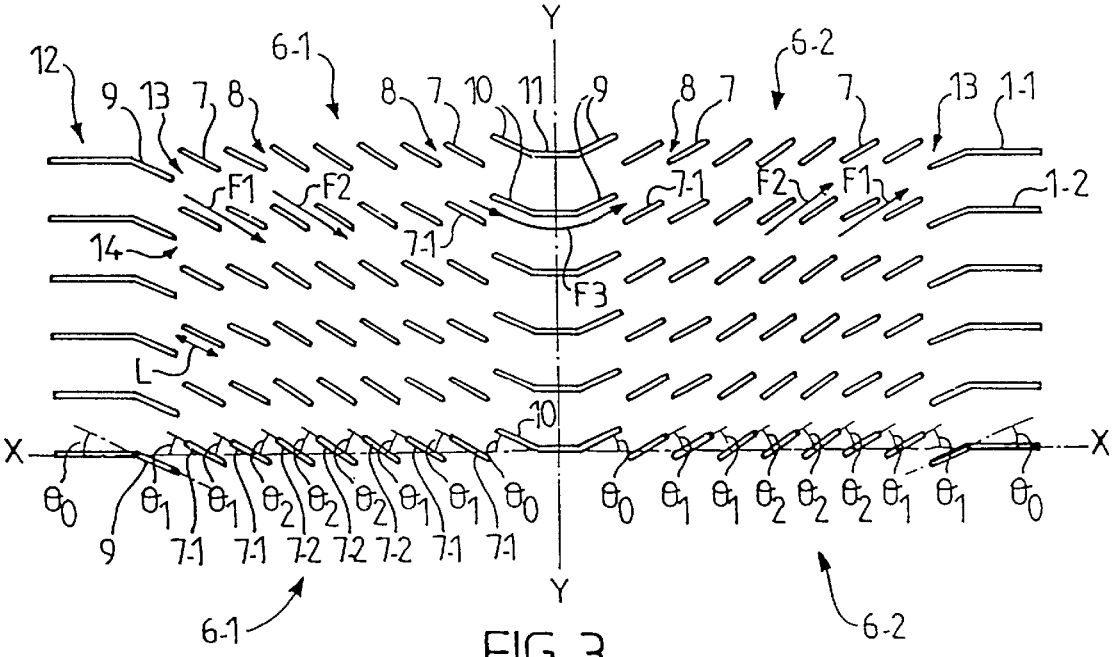
FIG. 3 is a diagrammetic view of part of a heat exchanger in accordance with the invention, in a preferred embodiment.

It is also preferred, as is shown in FIG. 3, that the lamellae in the first group have an inclination $\theta_1$ which is smaller than the inclination $\theta_2$ of the lamellae in the second group.

In particular, it is preferred that lamellae in groups having different order or serial numbers (such as 7-1, 7-2) have inclinations the magnitude of which depend on the order number of their group. More precisely, it is of particular advantage if the magnitude of the inclination increases with the value of the order number. Thus the angle $\theta_1$ of the lamellae in the first group will be smaller than the angle $\theta_2$ of the lamellae in the second group, which will be smaller than the angle $\theta_3$ of the lamellae in any third group, and so on.

In addition, with a view to ensuring that the change in direction applied to the second fluid, for example air, that flows between the lamellae of a set 6-1 or 6-2 shall be decelerated as progressively as possible, it is preferable that the lamellae in the first group 7-1 of the set of lamellae 6 should be located at the beginning and end of the set, so that they flank those lamellae which are part of groups having higher order numbers. In the example shown in FIG. 3, the set starts with two lamellae 7-1 of the first group, and is then continued by three lamellae 7-2 of the second group, while finally it terminates with two lamellae 7-1 of the first group.

It is of course not obligatory that the set of lamellae has a plane of symmetry, as is the case in the example shown in FIG. 3 in which the plane of symmetry is substantially in the centre of the second lamellae 7-2 of the second group. Similarly, it is perfectly possible to envisage that the set 6 consists only of lamellae 7-1 of a first group, followed by lamellae 7-2 of a second group, and possibly lamellae (7-3) of a third group.

By providing sets of lamellae 6-1, the second fluid which flows between the fins is subdivided into successive layers, the respective directions of which are different according to the angles of inclination of the lamellae between which they are flowing. To the extent that these layers, the direction of which is slightly inclined, precede the layers the direction of which is more severely inclined, the first of these layers will tend to urge the second or following layers against the walls, thus contributing to a substantial increase in the heat transfer surface, or indirect heat exchange surface areas, of the fins.

Two auxilary lamellae 9 and 10 are preferably arranged upstream and downstream, respectively, of a set 6 of lamellae 9. The width L of the upstream auxilarly lamella and the downstream auxilarly lamella 10 is the same as that of the lamellae 7 in the set 6. The auxilary lamellae 9 and 10 are again formed by press forming (stamping) of the central part 12 of the fin, and are spaced away from each of the preceding and following lamellae by an aperture 13 of selected dimensions. The dimensions of the aperature 13 are in practice substantially equal to those of the adjacent auxilary lamella. The free end 14 of each auxilary lamella 9 or 10 is located at a lower level than the respective levels of the various lamellae 7 in the set of which they form a part. This gives effective direction of the second fluid at the inlet and outlet ends of the set 6, and consequently improves guidance of the flow of the second fluid. Impingment of the fluid on the working edges of each lamella, and particularly on those of the first lamella 7-1 in the set, is then improved, thus reducing accordingly the probability of detachment of the boundary layers that form on the wall which constitutes a fin.

According to another preferred feature the upstream auxilary lamella 9 and the downstream auxilary lamella 10 have an inclination $\theta_0$ which is less than or equal to the inclination $\theta_1$ of the lamellae 7-1 in the first group. The inclination $\theta_0$ of the auxilary lamellae is then, preferably, smaller than the inclination $\theta_1$ by an angle in the approximate range 1° to 20°.

A complete slatted shutter element of the fin then comprises a set 6 of lamellae 7, disposed between two flanking auxilary lamellae 9 and 10. The angle of inclination $\theta$ preferably increases from the upstream auxilary lamella 9 at least up to the centre of the set of lamellae, after which it preferably decreases substantially symmetrically with the preceding increase, as far as the downstream auxilary lamella 10. This reduces even more the changes in direction imposed on the fluid, so still further improving the performance of the heat exchanger. The company Valeo Thermique Moteur has found that it is possible to obtain, using fins according to the invention such as are described above, to obtain substantial improvements in the performance of the heat exchanger. In addition, and as is shown in FIG. 3, a fin may have two sets 6-1 and 6-2 of lamellae 7, or more, for example three or four sets.

With a view to facilitating fluid flow between two superimposed fins 1-1 and 1-2, two sets 6-1 and 6-2 of identical lamellae are preferably arranged on each fin, but with the two sets being orientated in opposed directions. Thus, a layer of the second fluid that penetrates between, for example, two fins 7-1 of the first group in the first set 6-1 will naturally tend to leave between the two lamellae 7-1 of the second set 6-2 having an opposed inclination $\theta_1$, these being symmetrical with respect to the central axis Y—Y in FIG. 3. Similarly, a layer of the second fluid that penetrates between two lamellae 7-2 of the second group in the first set 6-1 will naturally tend to leave between two lamellae 7-2 in the second set 6-2, these having the opposite inclination $\theta_2$ and being symmetrical with respect to the axis Y—Y. This flow of fluids is indicated in FIG. 3, partially, by the arrows F1 and F2.

The distance by which the end of the first set 6-1 and the end of the second set 6-2 are seperated is generally chosen in such as way as to give direct flow, as indicated by the arrow F3, of the second fluid between the pairs which consist, firstly, of the first lamella 7-1 in the first set 6-1 and the downstream auxilary lamella 10 of the same set 6-1, and secondly, the upstream auxilary lamella 9 in the second set 6-2 and the first lamella 7-1 in the second set 6-2. For this purpose, the downstream auxilary lamella 10 in the first set 6-1 and the upstream auxilary lamella 9 in the second set 6-2 are both joined, to each other either directly or through a flat portion 11 as shown in FIG. 3. This flat portion is not of course essential. It depends in particular on the magnitude of the inclination of the auxilary lamellae.

It is thought preferable that the difference in the inclination between two neighbouring lamellae of two groups having successive order numbers (for example between a first group and a second group) should be in the approximate range 1° to 15°, so that the changes in direction of the adjacent layers of the second fluid will be progressive.

In addition, it is preferable that the maximum angle of inclination of the lamellae in one set (that is to say the lamellae in the group having the highest order numbers) should be less than 35°. In the example shown in FIG. 3, the three selected angles of inclination are accordingly equal, respectively, to 20° for $\theta_0$, 24° for $\theta_1$ and 28° for $\theta_2$. Nevertheless, other values of the angle of inclination can of course be envisaged, according to the chosen configurations.

In the example shown in FIG. 3, one fin is shown that has two sets of slatted shutter elements which are identical to each other but which have opposed orientations with respect to the axis Y—Y. In addition, the various fins in FIG. 3 are superimposed one above another and substantially parallel to one another, and are identical. It is however possible to conceive that asymmetrical fins can be made, that is to say fins having sets of non-identical lamellae. Similarly, the fins that are superimposed one above another may be different from each other, that is to say they may be in one or more series, each of which consists of groups of fins in which the number of lamellae and the numbers of different angles of inclination are not identical as between one fin and another.

The invention is just as well applicable to the insert type of fin shown in FIG. 1, as to plate fins of the type shown in FIG. 2.

The invention is not limited to the embodiment described in detail above by way of example only, but extends to other versions which will occur to a person skilled in the art within the scope of the claims of this application.

What is claimed is:

1. A metallic cooling fin for a heat exchanger, the fin having a central part having at least one set of inclined fixed lamellae and apertures of select dimensions separating said lamellae from each other to enable a fluid to pass between the lamellae, wherein a set of lamellae comprises at least two groups, each group consisting of at least one lamella, each lamella defining an angle of inclination, respective angles of inclination of the lamellae in said set varying between said groups, each group having an order number, the value of the order number increasing with the magnitude of the angles of inclination of the lamellae in a respective group, the fin further defining a plurality of ranks of lamellae, the lamellae in a first rank and a last rank, in a set of lamellae, being part of a first group of lamellae having a lowest order number.

2. A fin according to claim 1, wherein two adjacent lamellae of different inclinations constitute part, respectively, of two said groups of lamellae having successive order numbers.

3. A fin according to claim 1, having at least one set of lamellae comprising a plurality of groups of lamellae including a first group having a first inclination and a second group having a second inclination, the at least one set of lamellae defining a median plan of symmetry.

4. A fin according to claim 1, further including, upstream of the lamella of the first rank, a fixed upstream auxiliary lamella having dimensions at least equal to those of the lamellae in the set, the upstream auxiliary lamella and the lamella of the first rank defining an aperature of select form.

5. A fin according to claim 1, further including, downstream of the lamella of the last rank, a fixed downstream auxiliary lamella having dimensions at least equal to those of the lamellae in the set, the downstream auxiliary lamella and the lamella of the last rank defining an aperture of select form.

6. A fin according to claim 1, having at least two successive sets of lamellae comprising an upstream set and a downstream set, with a downstream auxiliary lamella of one of said sets and an upstream auxiliary lamella of an adjacent one of said sets joining said one set and said adjacent set together.

7. A fin according to claim 4, wherein the auxiliary lamellae define an inclination which is at most equal to an inclination of the lamellae in the first group of the set.

8. A fin according to claim 7, wherein the inclination of the auxiliary lamellae is less than the inclination of the lamellae in the first group by an amount in the range between 1° and 20°.

9. A fin according to claim 6, wherein the one set and the adjacent set of lamellae form two sets of adjacent lamellae having the same groups of lamella.

10. A fin according to claim 9, wherein the groups having the same order number in said two sets of adjacent lamellae have opposite orientations.

11. A fin according to claim 6, wherein the one set and the adjacent set each have different groups of lamellae.

12. A fin according to claim 1, wherein the lamellae define angles of inclination in the approximate range between 15° to 35°.

13. A fin according to claim 1, wherein the lamellae in the first group define an inclination smaller than an inclination defined by the lamellae in the group having the highest order number, by a value in the approximate range between 1° to 20°.

14. A fin according to claim 1, made of aluminum.

15. A fin according to claim 1, made of copper.

* * * * *